US012729464B2

(12) United States Patent
Hietpas et al.

(10) Patent No.: US 12,729,464 B2
(45) Date of Patent: Sep. 8, 2026

(54) BREATHABLE DOUBLE-KNIT OR INTERLOCK ELASTIC FABRIC WITH SINGLE COMPONENT MATERIAL

(71) Applicant: THE LYCRA COMPANY UK LIMITED, Manchester (GB)

(72) Inventors: Geoffrey D Hietpas, Newark, DE (US); Guan Wang, Avondale, PA (US); Qian Zhang, Shangqiu City (CN)

(73) Assignee: The LYCRA Company LLC, Wilmington, DE (US)

( * ) Notice: Subject to any disclaimer, the term of this patent is extended or adjusted under 35 U.S.C. 154(b) by 0 days.

(21) Appl. No.: 18/690,115

(22) PCT Filed: Aug. 25, 2022

(86) PCT No.: PCT/US2022/041447
§ 371 (c)(1),
(2) Date: Mar. 7, 2024

(87) PCT Pub. No.: WO2023/034102
PCT Pub. Date: Mar. 9, 2023

(65) Prior Publication Data

US 2024/0376646 A1 Nov. 14, 2024

Related U.S. Application Data

(60) Provisional application No. 63/238,297, filed on Aug. 30, 2021.

(51) Int. Cl.
*D04B 1/20* (2006.01)
*D04B 1/16* (2006.01)

(52) U.S. Cl.
CPC ..... *D04B 1/20* (2013.01); *D04B 1/16* (2013.01); *D10B 2201/02* (2013.01); *D10B 2403/0114* (2013.01)

(58) Field of Classification Search
CPC . D04B 1/123; D04B 1/12; D04B 1/16; D04B 1/18; D04B 1/20; D04B 1/14
See application file for complete search history.

(56) References Cited

U.S. PATENT DOCUMENTS 5,896,758 A * 4/1999 Rock ..... D04B 21/18 66/194
6,755,052 B1 * 6/2004 Sytz ..... D04B 1/18 66/196

(Continued)

FOREIGN PATENT DOCUMENTS

EP 0921221 B1 10/2003
EP 3647483 A1 5/2020

(Continued)

OTHER PUBLICATIONS

International Search Report for PCT/US2022/041447, mailed Nov. 14, 2022.

(Continued)

*Primary Examiner* — Danny Worrell
(74) *Attorney, Agent, or Firm* — Hoffmann & Baron, LLP

(57) ABSTRACT

An elastic double-knit or interlock fabric of non-elastomeric-elastic yarn which exhibits improved breathability and case of recyclability as compared to conventional elastic double-knit or interlock spandex fabrics, while maintaining the fabric weight and length and width stretch of conventional elastic double-knit or interlock spandex fabrics is provided. Also provided are methods for production of the elastic double-knit or interlock fabric and garments produced from the fabric.

20 Claims, 1 Drawing Sheet

(56) References Cited

U.S. PATENT DOCUMENTS

| | | | | |
|---|---|---|---|---|
| 6,779,369 | B2 * | 8/2004 | Shepherd | D04B 1/126 66/196 |
| 9,689,092 | B2 * | 6/2017 | Liao | D04B 1/18 |
| 11,746,450 | B2 * | 9/2023 | Cavanaugh | D04B 1/24 66/169 R |
| 2007/0238392 | A1 * | 10/2007 | Starbuck | D04B 1/18 66/149 R |

FOREIGN PATENT DOCUMENTS

| | | | |
|---|---|---|---|
| JP | H04361650 | A | 12/1992 |
| WO | 2018081057 | A1 | 5/2018 |
| WO | 2023034102 | A1 | 3/2023 |

OTHER PUBLICATIONS

Written Opinion of International Searching Authority for PCT/US2022/041447, mailed Nov. 14, 2022.

* cited by examiner

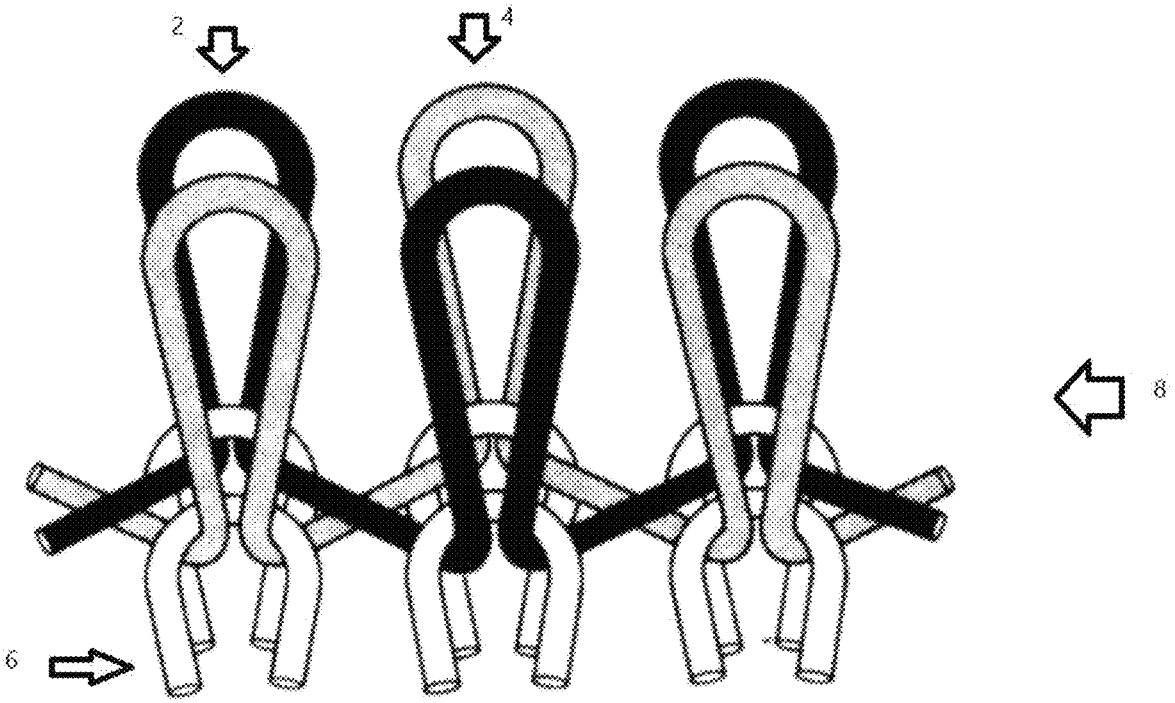
2
4
8
6

BREATHABLE DOUBLE-KNIT OR INTERLOCK ELASTIC FABRIC WITH SINGLE COMPONENT MATERIAL

This patent application claims the benefit of priority from U.S. provisional application Ser. No. 63/238,297 filed Aug. 30, 2021, the content of which is herein incorporated by reference in its entirety.

FIELD

This disclosure relates to an elastic double-knit or interlock fabric comprising a non-elastomeric-elastic yarn which exhibits improved breathability and ease of recyclability as compared to conventional elastic double-knit or interlock spandex fabrics, while maintaining the fabric weight and length and width stretch of conventional elastic double-knit or interlock spandex fabrics.

BACKGROUND

Knit fabrics are used broadly in active wear because of their ease in deformation and stretch resulting from compressing and elongating individual knit stitches comprised of interconnected loops that form the knit fabric. This ability to stretch in all directions resulting from stitch rearrangement provides for wearing comfort of garments made from knit fabrics even when knit fabric are made of 100% non-elastic yarn, such as polyester, nylon, cotton or wool. However, the recovery force of such non-elastic yarn is not strong enough to rearrange the knit stitches after deformation. Therefore, knit fabric made with 100% non-elastic yarn can experience permeant deformation or "bagging" in certain garment areas where more stretching occurs such as, but not limited to, the knee portion of pants.

Co-knitting spandex with the companion non-elastic yarn is commonly used to improve the recovery performance of knit fabric. The addition of spandex increases the fabric stretch level and improves recovery power for shape retention and comfort to the wearer of garments made with such fabrics. The spandex fiber typically is drafted to 200%-500% and co-knitted with non-elastic yarn. When the fabric is knitted, the recovery force from spandex helps to maintain the structure of the knit stitches.

However, spandex co-knitted fabric can have increased bulk and density resulting in a fabric with lower comfort due to reduced breathability resulting from reduced air permeability and/or increased levels of trapped moisture.

Alternative methods of making stretch fabric in the art that do not use spandex include use of non-elastomeric-elastic yarn such as textured polyethylene terephthalate (PET) stretch filament yarn, textured polypropylene terephthalate (PPT) stretch filament yarn, T400 yarn (PET/polytrimethylene terephthalate (PTT) side-by-side bicomponent), or polybutylene terephthalate (PBT) stretch yarn. However, the recovery force of such non-elastomer-elastic yarns is often quite low, being generally about 10-20% lower as compared to the recovery force of an equal denier spandex fiber. Therefore, to make a non-spandex stretch fabric with similar stretch property to a spandex stretch fabric, the content of non-elastomeric-elastic yarn in the non-spandex stretch fabric is usually at least 4 to 5 times more than the content of spandex in the spandex stretch fabric.

Compared to single knit fabric, double-faced weft knit fabric is firmer and more stable. Double-faced weft knit fabric also softer hand feel, better garment dimensional stability and abrasion resistance. The double-layer construction also makes fabric more opaque as compared to single knit fabric, thus effectively reducing "grin-through" issues. However, the double-layer construction has a negative impact on fabric breathability. For an elastic double-knit or interlock fabric with spandex, the air-permeability of fabric is doubly affected by both the two-layer construction and the construction compacting effect from spandex fiber.

Additionally, when spandex is included in an elastic fabric construction, it can make the process of fiber separation at end of life for recycling more complicated.

Therefore, there exists a need for a fabric with the opacity benefits of the double-knit or interlock construction that also maintains the fabric weight and the stretch and recovery properties similar to a spandex fabric, without the decreased breathability and without the complications of having a spandex fiber included for purposes of more facile fiber separation for recyclability.

SUMMARY

This disclosure relates to elastic double-knit or interlock fabric with better breathability and similar weight and stretch properties as compared to elastic double-knit or interlock fabrics with spandex.

An aspect of this disclosure relates to a double-knit or interlock fabric 8 comprising a first layer of fabric 2 and a second layer of fabric 4, at least one of which comprises a non-elastomeric-elastic yam, and a yarn 6 binding said first and second layers of fabric together.

In one nonlimiting embodiment, the fabric comprises a first layer of fabric comprising a non-elastomeric-elastic yarn and a second layer of fabric comprising a non-elastomeric-elastic yarn and a yarn binding the first and second layers together.

In one nonlimiting embodiment, the yarn binding the first and second layers together is a non-elastomeric-elastic yarn.

In one nonlimiting embodiment, the first layer of fabric comprises non-elastomeric-elastic yarn and non-elastic yarn knitted together on dial needles.

In one nonlimiting embodiment, the second layer of fabric comprises a non-elastomeric-elastic yarn and a non-elastic yarn knitted together on cylinder needles.

In one nonlimiting embodiment, both the first and second layers comprise non-elastomeric-elastic yarn and non-elastic yarn.

In one nonlimiting embodiment, the non-elastic yarn is combined with the non-elastomeric-elastic yarn by plaiting or twisting, entanglement, or co-insertion prior to being fed to the needles.

In one nonlimiting embodiment, the double-knit or interlock fabric does not contain any spandex yarns.

Another aspect of the present disclosure relate to articles of manufacture at least a portion of which comprises the double-knit or interlock fabric disclosed herein.

In one nonlimiting embodiment, the article of manufacture is a garment.

In one nonlimiting embodiment, the garment is an active wear or intimate wear garment.

Yet another aspect of the present invention relates to a method for producing the double-knit or interlock fabric disclosed herein. The method comprises knitting yarns into a first layer of fabric and knitting yarns into a second layer of fabric wherein at least one of said first or second layers of fabric comprises a non-elastomeric-elastic yarn, and binding the first and second layers together with yarn.

BRIEF DESCRIPTION OF THE DRAWING

FIG. 1 illustrates an aspect of the present invention of an example of an interlock fabric 8 comprising a first layer of fabric 2 and a second layer of fabric 4, and a yarn 6 binding the first and second layers together.

DETAILED DESCRIPTION

Provided by this disclosure are elastic double-knit or interlock fabrics with better breathability and similar weight and stretch properties as compared to elastic double-knit or interlock fabrics with spandex, as well as methods for their production and use in articles of manufacture including, but in no way limited to active wear and intimate wear garments.

"Elastic fiber" or "elastic yarn" as used herein refers to the fiber or the yarn with elastic and recovery properties. Elastic fiber or elastic yarn includes elastomeric fibers, such as, but not limited to, spandex, biconstituent filament, lastol filament, elastoester, and non-elastomeric-elastic fibers such as, but not limited to, polyester bi-component stretch fiber, textured PPT stretch filament, textured PET stretch filament, or PBT stretch filament. "Elastic yarn" and "elastic fiber" are used interchangeably in this context herein.

Elastomeric fibers are commonly used to provide stretch and elastic recovery in fabrics and garments. "Elastomeric fibers" are either a continuous filament (optionally a coalesced multifilament) or a plurality of filaments, free of diluents, which have a break elongation in excess of 100% independent of any crimp. An elastomeric fiber when (1) stretched to twice its length; (2) held for one minute; and (3) released, retracts to less than 1.5 times its original length within one minute of being released. As used in the text of this specification, "elastomeric fibers" means at least one elastomeric fiber or filament. Such elastomeric fibers include but are not limited to rubber filament, biconstituent filament and elastoester, lastol, and spandex.

"Spandex", as used herein, refers to a manufactured filament in which the filament-forming substance is a long chain synthetic polymer comprised of at least 85% by weight of segmented polyurethane.

"Polyester bi-component filament", as used herein, refers to a continuous filament comprising two polyester materials intimately adhered to each other along the length of the fiber, so that the fiber cross section is, for example, a side-by-side, eccentric sheath-core or other suitable cross-section from which useful crimp can be developed. The polyester bicomponent filament comprises poly(trimethylene terephthalate) and at least one polymer selected from the group consisting of poly(ethylene terephthalate), poly(trimethylene terephthalate), and poly(tetramethylene terephthalate) or a combination of such members, having an after heat-set crimp contraction value of from about 10% to about 80%. Crimp contraction is determined as described in U.S. Pat. No. 7,310,932 B2.

"Non-elastomeric-elastic yarn", as used herein, refers to a stretch filament without containing elastomeric fiber. The recoverable stretch must be higher than 15% as tested by ASTM D6720-07. Examples include textured PTT, textured PET, bi-component stretch fiber, or PBT. These yarns develop additional crimp upon exposure to temperatures above standard room temperature (20° C.).

"Grin-through" describes the exposure in a fabric of and elastic yarn to view when stretched. Grin-through can manifest itself as an undesirable glitter. If a choice must be made, low grin through on the face side is more desirable than low grin-through on the back side.

"Draft" refers to the amount of stretch applied to the spandex during use in knitting or covering or twisting with another fiber. The draft of a fiber is directly related to the elongation (stretching) applied to the fiber (e.g. 100% elongation corresponds to 2× draft, 200% elongation corresponds to 3× draft, etc).

"Hard yarn" means a knitting yarn, which does not contain an elastic yarn, such as a spun cotton yarn, textured polyester filament or a nylon synthetic fiber.

The double-knit or interlock fabrics of this disclosure comprise a first layer of fabric. In one nonlimiting embodiment, the first layer of fabric comprises non-elastomeric-elastic yarn. In one nonlimiting embodiment, the first layer of fabric comprises non-elastomeric-elastic yarn and non-elastic yarn knitted. In one nonlimiting embodiment, the first layer of fabric is knitted on dial needles.

The double-knit or interlock fabrics of this disclosure further comprise a second layer of fabric. In one nonlimiting embodiment, the second layer of fabric comprises non-elastomeric-elastic yarn. In one nonlimiting embodiment, the second layer of fabric comprises non-elastomeric-elastic yarn and non-elastic yarn. In one nonlimiting embodiment the second layer of fabric is knitted on cylinder needles.

In one nonlimiting embodiment, both the first and second layers of fabric comprise non-elastomeric-elastic yarn and non-elastic yarn knitted together.

In one nonlimiting embodiment, the non-elastic yarn is combined by plaiting or twisting, or entanglement, or co-insertion, with the non-elastomeric-elastic yarn and then fed to the needles.

The double-knit or interlock fabrics of this disclosure also comprise a yarn binding the first and second fabric layers together. In one nonlimiting embodiment, this yarn is a non-elastomeric-elastic yarn. In one nonlimiting embodiment, cylinder needles are used to bind the two layers together with this yarn.

Nonlimiting examples of non-elastomeric-elastic yarn useful in the double-knit or interlock fabrics of this disclosure include yarns comprising polyethylene terephthalate, poly(trimethylene terephthalate) or poly(tetramethylene terephthalate) or any combinations thereof. In one nonlimiting embodiment, the non-elastomeric-elastic yarn is a polyester bi-component filament comprising poly(trimethylene terephthalate) and at least one polymer selected from the group consisting of polyethylene terephthalate, poly (trimethylene terephthalate), and poly(tetramethylene terephthalate) or any combination thereof. Yarn denier of the non-elastomeric-elastic yarns can range from about 20 to about 600. Fabrics of this disclosure comprise about 5 to 10 weight percent up to about 85 weight percent of the non-elastomeric-elastic yarn, based on total weight of the fabrics.

While not being bound to any particular theory, it is believed that the non-elastomeric-elastic yarns cause the fabric to shrink and the yarns within to pull together during fabric and garment finishing process.

Nonlimiting examples of non-elastic yarn useful in the double-knit or interlock fabrics of this disclosure include yarns comprising polyester, nylon, or cotton and combinations thereof. Fabrics of this disclosure comprise about 15 weight percent up to about 95 weight percent of the non-elastomeric-elastic yarn, based on total weight of the fabrics.

In one nonlimiting embodiment, the non-elastic yarn is a blended yarn comprising at least 50% of one or more of polyester, nylon, or cotton.

In one nonlimiting embodiment, the non-elastic yarn is dyed before knitting. In one nonlimiting embodiment, the non-elastic yarn is indigo dyed yarn. In one nonlimiting embodiment, the non-elastic yarn comprises yarn that is dyed to a selected color and the non-elastomeric-elastic yarn is not dyed or dyed to a different selected color.

In some nonlimiting embodiments, the double-knit or interlock fabrics does not contain any spandex yarns.

Yarns used in these fabrics may further comprise property enhancing additives such as, but not limited to, additives for moisture management, thermal resistance, anti-bacteria activity, and soft hand properties.

This disclosure also relates to methods for producing these double-knit or interlock fabrics.

Such methods comprise knitting yarns into a first layer of fabric and knitting yarns into a second layer of fabric wherein at least one of said first or second layers of fabric comprises a non-elastomeric-elastic yarn, and binding the first and second layers together with yarn.

In one nonlimiting embodiment, the first layer of fabric comprises non-elastomeric-elastic yarn and non-elastic yarn. In one nonlimiting embodiment, the first layer of fabric is knitted on dial needles.

In one nonlimiting embodiment, the second layer of fabric comprises non-elastomeric-elastic yarn and non-elastic yarn. In one nonlimiting embodiment, the second layer of fabric is knitted on cylinder needles.

In one nonlimiting embodiment, both the first and second layers of fabric comprise non-elastomeric-elastic yarn and non-elastic yarn.

In one nonlimiting embodiment, the non-elastic yarn is combined by plaiting or twisting, or entanglement, or co-insertion, with the non-elastomeric-elastic yarn prior to being fed to knitting needles.

The method then further comprises binding the first and second layers together with yarn. In one nonlimiting embodiment, the yarn binding the first and second layers together is a non-elastomeric-elastic yarn. In one nonlimiting embodiment, cylinder needles are used to bind the two layers together with this yarn.

Various knitting machines can be used to produce these fabrics including, but not limited to circular knit machines, seamless machines and flat knit machines.

Fabrics disclosed herein are substantially free of grin-through of the non-elastomeric-elastic yarn.

Such fabrics are useful in various articles of manufacture including garments, at least a portion of which comprise the disclosed fabric. The enhanced breathability of the fabrics combined with similar weight and stretch properties as compared to elastic double-knit or interlock fabrics comprised of spandex make these fabrics ideal for use in active wear and intimate wear, such as, but not limited to, bras, underwear, shaping wear, camisoles, leggings and sport bras.

Table 1 provides a nonlimiting example of a stitch pattern used to form an elastic double-knit or interlock fabric of this disclosure.

TABLE 1

| construction of double knit fabric | | | |
|---|---|---|---|
| | | Cam block 1 | Cam block 2 |
| Feed 1 | Dial | — | — |
| (Cylinder yarn) | Cylinder | K | K |
| Feed 2 | Dial | K | K |
| (Dial yarn) | Cylinder | — | — |
| Feed 3 | Dial | — | T |
| (Binding yarn) | Cylinder | T | — |
| Feed 4 | Dial | — | — |
| (Cylinder yarn) | Cylinder | K | K |
| Feed 5 | Dial | K | K |
| (Dial yarn) | Cylinder | — | — |

TABLE 1-continued

| construction of double knit fabric | | | |
|---|---|---|---|
| | | Cam block 1 | Cam block 2 |
| Feed 6 | Dial | T | — |
| (Binding yarn) | Cylinder | — | T |

"T": Tuck stitch
"K": knit stitch
"—": float stitch

Fabric was made using a 24-gauge double knit circular knitting machine (model type: RH 216-J) manufactured by Terrot in Germany.

The following test methods were used to characterize fabrics of this disclosure.

Fabric Recovery Force and Elongation

Fabric tensile testing was performed according to ASTM D4964-96. The samples were conditioned for 16 hours at 70° F. and 65% relative humidity. Fabric tensile tests were performed by cycling to 50% elongation at 200% per minute. The fabric recovery force at 30% elongation on the third cycle is recorded as fabric recovery force.

Fabrics were evaluated for % elongation under 7 kg load force in the fabric weft and warp directions.

Fabric Air Permeability

Fabric air permeability was measured according to ASTM D737, using a TEXTEST FX 3300 machine, Zurich Switzerland.

The features and advantages of the fabrics of this disclosure invention are more fully shown by the following examples which are provided for purposes of illustration, and are not to be construed as limiting the invention in any way.

EXAMPLES

Comparative Example 1

A double jersey fabric was made with 70 denier/88 filament polyester yarn plaited with 20 denier LYCRA® spandex fiber on dial needles and the same set of yarns on cylinder needles to form both layers of fabric. A 20 denier LYCRA® spandex fiber on cylinder needles was used to bind the two layers together. The draft of all LYCRA® spandex fiber in the fabric during knitting was 3.25×.

Comparative Example 2

A double jersey fabric was made with 50 denier/72 filament polyester yarn on dial needles and the same set of yarns on cylinder needles to form both layers of fabric. A 20 denier LYCRA® spandex fiber on cylinder needles was used to bind the two layers together. The draft of all LYCRA® spandex fiber in the fabric during knitting was 3.25×.

Comparative Example 3

A double jersey fabric was made using 50 denier/72 filament polyester yarn on dial needles and the same set of yarns on cylinder needles to form both layers of fabric. A 30 denier LYCRA® spandex fiber on cylinder needles was used to bind the two layers together. The draft of all LYCRA® spandex fiber in the fabric during knitting is 3.25×.

Comparative Example 4

A double jersey fabric was made using 50 denier/72 filament polyester yarn on dial needles and 50 denier/72 filament polyester yarn plaited with 30 denier LYCRA® spandex fiber on cylinder needles to form both layers of fabric. A 20 denier Nylon yarn on cylinder needles was used to bind the two layers together. The draft of all LYCRA® spandex fiber in the fabric during knitting was 3.25×.

Comparative Example 5

A double jersey fabric was made using 50 denier/72 filament polyester yarn plaited with 20 denier LYCRA® spandex fiber on dial needles and 50 denier/72 filament polyester yarn plaited with 20 denier LYCRA® spandex fiber on cylinder needles to form both layers of fabric. A 20 denier Nylon yarn on cylinder needles was used to bind the two layers together. The draft of all LYCRA® spandex fiber in the fabric during knitting was 3.25×.

Example 6

A double jersey fabric was made using 70 denier/88 filament polyester yarn plaited with 20 denier LYCRA® T400 fiber (polyester bi-component fiber) on dial needles to knit one layer of fabric and 20 denier LYCRA® T400 fiber on cylinder needles to knit the other layer of fabric. A 20 denier LYCRA® T400 fiber on cylinder needles was used to bind the two layers together.

Example 7

A double jersey fabric was made using 20 denier LYCRA® T400 fiber (polyester bi-component fiber) on dial needles to knit one layer of fabric and 70 denier/88 filament polyester yarn plaited with 20 denier LYCRA® T400 fiber on cylinder needles to knit the other layer of fabric. A 15 denier nylon fiber on cylinder needles was used to bind the two layers together.

Example 8

A double jersey fabric was made using 70 denier/88 filament polyester yarn plaited with 20 denier LYCRA® T400 fiber (polyester bi-component fiber) on dial needles to knit one layer of fabric and 70 denier/88 filament polyester yarn plaited with 20 denier LYCRA® T400 fiber on cylinder needles to knit the other layer of fabric. A 20 denier LYCRA® T400 fiber on cylinder needles was used to bind the two layers together.

Results from Fabric Recovery Force and elongation and Fabric air permeability testing are depicted in Table 2.

TABLE 2

| Fabric ID | Dial needle feed | Cylinder needle feed | Cylinder needle feed (binding yarn) | Elastic fiber content | Fabric Weight, gsm | Fabric recovery force, gram force | Fabric elongation | Air-Perm, cfm |
|---|---|---|---|---|---|---|---|---|
| 1C | 70D/88f COOLMAX + 20D LYCRA(r) 162L | 70D/88f COOLMAX + 20D LYCRA(r) 162L | 20D LYCRA(r) 162L | 18% | 185 | Warp: 135 Weft: 78 | Warp: 89% Weft: 208% | 24 |
| 2C | 50D/72f PES SD DTY | 50D/72f PES SD DTY | 20D LYCRA(r) 162L | 6.6% | 108 | Warp: N/A Weft: 246 | Warp: N/A Weft: 208% | 439 |
| 3C | 50D/72f PES SD DTY | 50D/72f PES SD DTY | 30D LYCRA(r) 162L | 9.4% | 111 | Warp: N/A Weft: 259 | Warp: N/A Weft: 208% | 443 |
| 4C | 50D/72f PES SD DTY | 50D/72f PES SD DTY + 30D LYCRA ® 162L | 20D Nylon | 6.5% | 221 | Warp: 486 Weft: 425 | Warp: 96% Weft: 146% | 126 |
| 5C | 50D/72f PES SD DTY + 20D LYCRA ® 162L | 50D/72f PES SD DTY + 20D LYCRA ® 162L | 20D Nylon | 9.2% | 226 | Warp: 595 Weft: 600 | Warp: 98% Weft: 121% | 127 |
| 6 | 70D/88f COOLMAX + 20D T400 | 20D T400 | 20D T400 | 46% | 205 | Warp: 345 Weft: 209 | Warp: 70% Weft: 98% | 45 |
| 7 | 20D T400 | 70D/88f COOLMAX + 20D T400 | 15D Nylon | 32% | 205 | Warp: 368 Weft: 222 | Warp: 69% Weft: 87% | 31 |
| 8 | 70D/88f COOLMAX + 20D T400 | 70D/88f COOLMAX + 20D T400 | 20D T400 | 30% | 220 | Warp: 210 Weft: 158 | Warp: 87% Weft: 134% | 110 |

From Table 2, it can be seen that Example 1C, a comparative example, has lower fabric recovery force and low air permeability as compared to Examples 6-8 of this invention. For Examples 2C and 3C, it was shown that they only stretch in one direction. In contrast, the yarn combinations and construction of Examples 6-8 of this invention have bi-stretch, where bi-stretch means they have fabric elongation in both the warp and weft directions. For comparative examples 4C and 5C, while they exhibited a desirable balance of high recovery power, bi-stretch, and good air permeability, they also contain spandex fiber which means they have an additional fiber component as compared to Examples 6-8 of this invention which makes recycling more complicated as compared to Examples 6-8 based solely on polyester based fiber chemistries.

What is claimed is:

1. A double-knit or interlock fabric comprising a first layer of fabric and a second layer of fabric, wherein the first layer and the second layer comprise yarns or fibers selected from the group consisting of non-elastomeric-elastic yarn(s)/fiber (s) blended with non-elastic yarn(s)/fiber(s), and non-elastomeric elastic yarn(s)/fiber(s), and wherein at least one of the first layer or the second layer comprises a non-elastomeric-elastic yarn/fiber and a non-elastic yarn/fiber, and a yarn binding the first and second layers together, wherein the non-elastomeric-elastic yarn/fiber comprises one or more of polyethylene terephthalate, poly(trimethyleneterephthalate), and poly(tetramethylene terephthalate) or any combination thereof.

2. The double-knit or interlock fabric of claim 1 wherein the yarn binding the first and second layers together is a non-elastomeric-elastic yarn.

3. The double-knit or interlock fabric of claim 1, wherein the first layer of fabric comprises non-elastomeric-elastic yarn and non-elastic yarn.

4. The double-knit or interlock fabric of claim 1 wherein the first layer of fabric is knitted on dial needles.

5. The double-knit or interlock fabric of claim 1, wherein the second layer of fabric comprises a non-elastomeric-elastic yarn and a non-elastic yarn.

6. The double-knit or interlock fabric of claim 1, wherein the second layer of fabric is knitted on cylinder needles.

7. The double-knit or interlock fabric of claim 1, wherein the non-elastic yarn is combined by plaiting or twisting, or entanglement, or co-insertion, with the non-elastomeric-elastic yarn and fed to knitting needles.

8. The double-knit or interlock fabric of claim 1, wherein the non-elastomeric-elastic yarn is a polyester bi-component filament comprising poly(trimethylene terephthalate) and at least one polymer selected from the group consisting of polyethylene terephthalate), poly(trimethylene terephthalate), and poly(tetramethyleneterephthalate) or any combination thereof.

9. The double-knit or interlock fabric of claim 1, wherein the yarn denier of the non-elastomeric-elastic yarn is from about 20 to about 600.

10. The double-knit or interlock fabric of claim 1, wherein the non-elastic yarn comprises polyester, nylon, or cotton.

11. The double-knit or interlock fabric of claim 10, wherein the non-elastic yarn is a blended yarn comprising at least 50% of one or more of polyester, nylon, or cotton.

12. The double-knit or interlock fabric of claim 1, wherein the non-elastic yarn is dyed before knitting.

13. The double-knit or interlock fabric of claim 12, wherein the non-elastic yarn is indigo dyed yarn.

14. The double-knit or interlock fabric of claim 1, wherein the non-elastic yarn comprises a yarn that is dyed to a color and the non-elastomeric-elastic yarn is not dyed or dyed to a different color.

15. The double-knit or interlock fabric of claim 1 produced using a circular knit machine, a seamless machine, or a flat knit machine.

16. A garment at least a portion of which comprises the double-knit or interlock fabric of claim 1.

17. A method for producing the double-knit or interlock fabric of claim 1, said method comprising:

knitting yarns into a first layer of fabric; and knitting yarns into a second layer of fabric, wherein at least one of the first or second layers of fabric comprises a non-elastomeric-elastic yarn; and binding the first and second layers together with yarn.

18. The method of claim 17, wherein the first layer of fabric comprises non-elastomeric-elastic yarn and non-elastic yarn knitted together on dial needles.

19. The method of claim 17, wherein the second layer of fabric comprises a non-elastomeric-elastic yarn and a non-elastic yarn knitted together on cylinder needles.

20. The method of claim 17, wherein the yarn binding the first and second layers together is a non-elastomeric-elastic yarn.

* * * * *